US005839879A

United States Patent [19]

Kameoka et al.

[11] Patent Number: 5,839,879

[45] **Date of Patent: *Nov. 24, 1998**

[54] CENTRIFUGAL BLOWER

[75] Inventors: Teruhiko Kameoka, Okazaki; Koji Ito, Nagoya; Kouji Matsunaga, Kariya, all of Japan

[73] Assignee: Denso Corporation, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 757,189

[22] Filed: Nov. 27, 1996

[30] Foreign Application Priority Data

Dec. 5, 1996 [JP] Japan ..... 7-316916

[51] Int. Cl.[6] ..... F04D 29/44

[52] U.S. Cl. ..... 415/206

[58] Field of Search ..... 415/203, 204, 415/206

[56] References Cited

U.S. PATENT DOCUMENTS 5,281,092 1/1994 Sullivan ..... 415/206

FOREIGN PATENT DOCUMENTS 145497 7/1985 Japan ..... 415/206
A-5-195995 8/1993 Japan .

*Primary Examiner*—John T. Kwon
*Attorney, Agent, or Firm*—Harness, Dickey & Pierce, PLC

[57] ABSTRACT

A scroll casing of a centrifugal blower holds a centrifugal fan therein and defines an air passage around the centrifugal fan. The scroll casing has a scroll starting position at the most upstream portion of the air passage, a scroll ending position at a downstream portion thereof, and an air outlet at the most downstream side thereof. Between the scroll ending position and the air outlet, the scroll casing has a warped face and a guide face. Accordingly, an air flow flowing apart from the fan and an air flow flowing close to the fan are prevented from mixing with each other. As a result, interference between the air flows and blades of the fan is generally prevented, whereby noise is decreased.

4 Claims, 5 Drawing Sheets

CENTRIFUGAL BLOWER

CROSS REFERENCE TO RELATED APPLICATION

This application is based upon and claims the benefit of priority of the prior Japanese Patent Application No. 7-316916 filed on Dec. 5, 1995, the content of which is incorporated herein by reference.

BACKGROUND OF THE INVENTION

1. FIELD OF THE INVENTION

The present invention relates to a centrifugal blower suitable for use in an automotive air conditioning system.

2. RELATED ARTS

A centrifugal blower is typically composed of a centrifugal fan for drawing air in parallel with its rotational axis and blowing the air out in parallel with its radial direction, and a scroll casing formed around the rotational axis of the centrifugal fan in a spiral shape. The air is blown out from the centrifugal fan with a flow speed approximately equal to the rotational speed of the centrifugal fan, and flows in the scroll casing to be blown out from an air outlet of the scroll casing. In the scroll casing, although the flow speed of the air is reduced, the pressure of the air is increased. The flow speed and the pressure of air blown out from the air outlet of the scroll casing is strongly related to a shape of the scroll casing. Therefore, optimizing the shape of the scroll casing is very important to improve performance of the centrifugal blower for blowing out air.

Japanese Unexamined Patent Publication No. 5195995 proposes a centrifugal blower in which a shape of a scroll casing defining an air passage is optimized. In the centrifugal blower, a cross-sectional area of the air passage becomes larger in an opposite direction of an air inlet of a centrifugal fan as it approaches an air outlet of the scroll casing. Further, the scroll casing has a sloped face which extends from the fan in parallel with a direction in which air is blown out from the centrifugal fan.

The present inventors examined the above mentioned centrifugal blower. As a result, although a required amount of air blown out from the centrifugal blower could be attained, a required noise reduction level could not be attained.

In the centrifugal blower, as shown in FIG. 10, the scroll shape of the casing starts at the position 11 and ends at the position 12, and the air flow in the passage 3*a* communicates with a window 13. In the air passage 3*a*, a flow speed of air flowing in the portion enlarged toward the opposite direction of the air inlet (hereinafter called a secondary air flow) is slower than that flowing close to the centrifugal fan (hereinafter called a main air flow). Therefore, the secondary air flow is mixed with the main air flow around the window 13, and the mixed secondary air flow interferes with the main flow and the blades 2 of the centrifugal fan 1, thereby generating noise.

SUMMARY OF THE INVENTION

The present invention has been accomplished in view of the above-mentioned problem, and an object of the present invention is to provide a centrifugal blower having an improved scroll casing to reduce noise generated therein.

According to the present invention, a scroll casing of a centrifugal blower, which holds a centrifugal fan and defines an air passage around the centrifugal fan, has a scroll shape with a scroll starting position at a most upstream portion of the air passage and a scroll ending position at a downstream portion thereof from which the air passage further stretches in its tangential direction. Further, the scroll casing includes an air outlet at the most downstream portion of the air passage, an upper scroll casing disposed at one end of the centrifugal fan and having an air inlet, a lower scroll casing disposed at the other end of the centrifugal fan, and a side scroll casing connecting the upper and the lower scroll casings.

The lower scroll casing further has a ring-shaped face disposed to face the centrifugal fan, a sloped face connected to the ring-shaped face and sloped outwardly in a radial direction of the centrifugal fan, and a base face for connecting the sloped face and the side scroll casing.

In this lower scroll casing, a width of the sloped face in the radial direction of the centrifugal fan is continuously changed to become larger from the scroll starting position to the scroll ending position so that a cross-sectional area of the air passage becomes larger. Further, an angle made by the sloped face and the ring-shaped face is constant from the scroll starting position to the neighborhood of the scroll ending position, and it is continuously changed to become larger from the neighborhood of the scroll ending position to the air outlet.

Accordingly, in the air passage, a secondary air flow flowing at the portion enlarged outwardly is generally prevented from mixing with a main air flow flowing close to the centrifugal fan. As a result, interference between the centrifugal fan and the air flows is prevented, and noise generated by the interference is lowered.

Preferably, the ring-shaped face of the scroll casing extends in a tangential direction thereof from the scroll ending position and functions as a guide wall for guiding air to the air outlet around a window of the air passage.

Accordingly, the main air flow is prevented from being deflected toward the secondary air flow, whereby the interference between the main air flow and the secondary air flow can be prevented.

Preferably, the sloped face is connected to the ring-shaped face through an edge face, whereby air blown out from the centrifugal fan flows smoothly. Therefore, turbulence of air is prevented, and noise is further lowered.

Other objects and features of the present invention will become more readily apparent from a better understanding of the preferred embodiments described below with reference to the following drawing figures.

DETAILED DESCRIPTION OF THE PREFERRED EMBODIMENT

An embodiment according to the present invention will be described hereinunder with reference to the drawings.

In the embodiment, a centrifugal blower (hereinafter called a blower) according to the present invention is used as a blower in an automotive air conditioning system.

Figure 1:
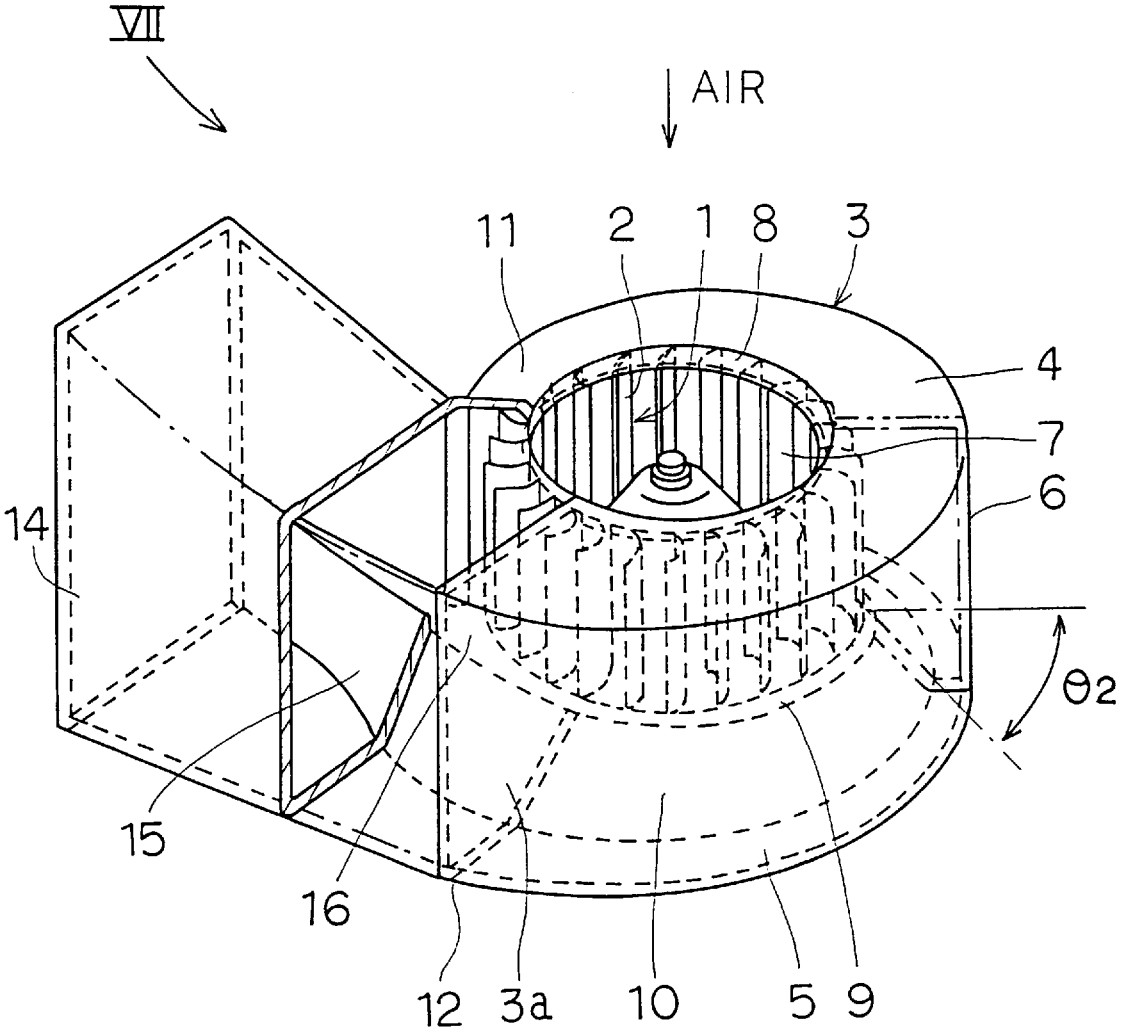
FIG. 1 is a perspective view showing a centrifugal blower as an embodiment according to the present invention.

As shown in FIG. 1, the blower is composed of a centrifugal fan 1 (hereinafter called a fan) having plural blades 2, and a scroll casing 3. The blades 2 are disposed on a circumference of the fan 1, and their longitudinal direction is aligned in parallel to a rotational axis of the fan 1. The fan 1 is rotated by a motor 1*a* (see FIG. 7) to draw air in the rotational axis direction of the fan 1 and to blow it out in a radial direction thereof.

The scroll casing 3 (hereinafter called a casing) receives the fan 1 and forms an air passage 3*a* for air blown out from the fan 1. The casing 3 is formed to scroll around the fan 1, and has an air outlet 14 at an end thereof.

The casing 3 is composed of an upper scroll casing 4 (hereinafter called as an upper casing) formed at one end of the fan 1 , a lower scroll casing 5 (hereinafter called a lower casing) formed at the other end of the fan 1, and a side scroll casing 6 (hereinafter called a side casing) forming an outer periphery of the casing 3. The casings 4, 5 and 6 are made of resin and assembled with C-shaped clamps (not shown in the drawing) or the like.

The upper casing 4 has an air inlet 7 for drawing air and a bell mouth 8 at an edge of the air inlet 7 for preventing interference between air to be drawn and air flowing in the air passage 3*a*.

The lower casing 5 has a partially circular ring-shaped face 9 for holding and fixing the motor 1*a*. As shown in FIG. 1, the ring-shaped face 9 extends outwardly from a neighborhood of an outer diameter of the fan 1. The outwardly extended portion of the ring-shaped face 9 is about 5 mm in this embodiment. The lower casing 5 further has a sloped face 10 which is connected to the ring-shaped face 9 and declines outwardly.

Figure 3:
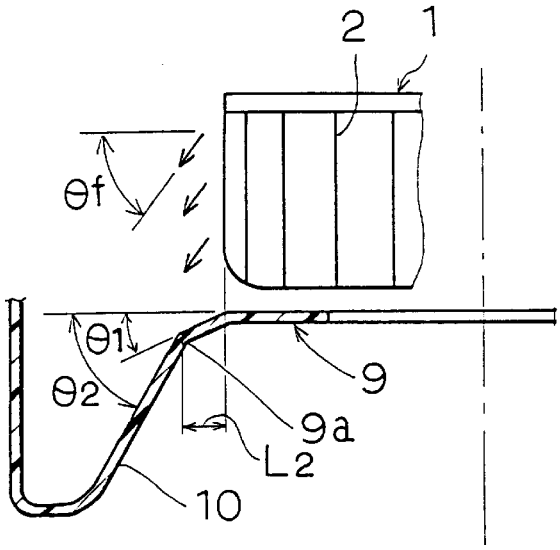
FIG. 3 is a partial enlarged cross-sectional view along the III—III line in FIG. 2.
Figure 4:
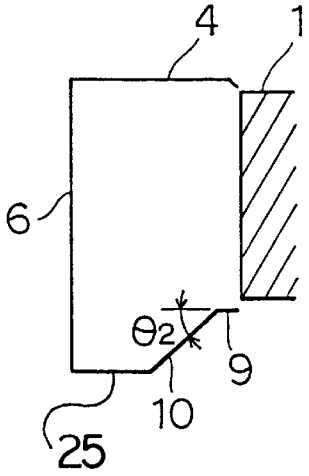
FIG. 4 is a fragmentary cross-sectional view along the IV—IV line in FIG. 2.
Figure 5:
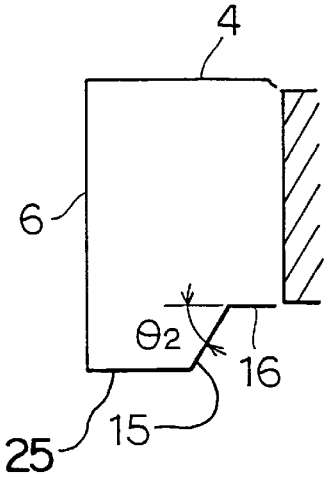
FIG. 5 is a fragmentary cross-sectional view along the V—V line in FIG. 2.
Figure 6:
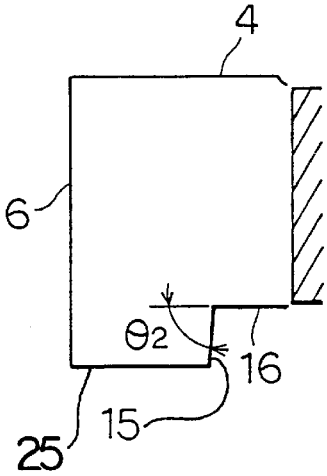
FIG. 6 is a fragmentary cross-sectional view along the VI—VI line in FIG. 2, showing the centrifugal blower.

As shown in FIG. 3, the ring-shaped face 9 has an outside edge face 9*a* and is connected to the sloped face 10 through the outside edge face 9*a* to round off the corner, and a cross-sectional shape of these connected faces 9, 9*a* and 10 has two bending points. The ring-shaped face 9 may be connected to the sloped face 10 through plural edge faces so that the cross-sectional shape has plural bending points. An angle $\theta_1$ made by surfaces of the ring-shaped face 9 and the outside edge face 9*a* is appropriate to be in a range of 0°–300° and, in this embodiment, it is 30°.

An angle $\theta_2$ (hereinafter called a sloped angle) made by surfaces of the ring-shaped face 9 and the sloped face 10 is chosen so that the sloped face 10 is generally parallel to the direction ($\theta_f$) in which air is blown out from the fan 1. It is appropriate to choose the angle $\theta_2$ in a range of 15°–75°. In this embodiment, the sloped angle $\theta_2$ is chosen to be constant from a scroll starting position 11 to a scroll ending position 12.

From the scroll ending position 12, the sloped angle $\theta_2$ becomes larger as it approaches the air outlet 14, whereby the sloped face 10 forms a warped face 15 as shown in FIG. 1.

Figure 2:
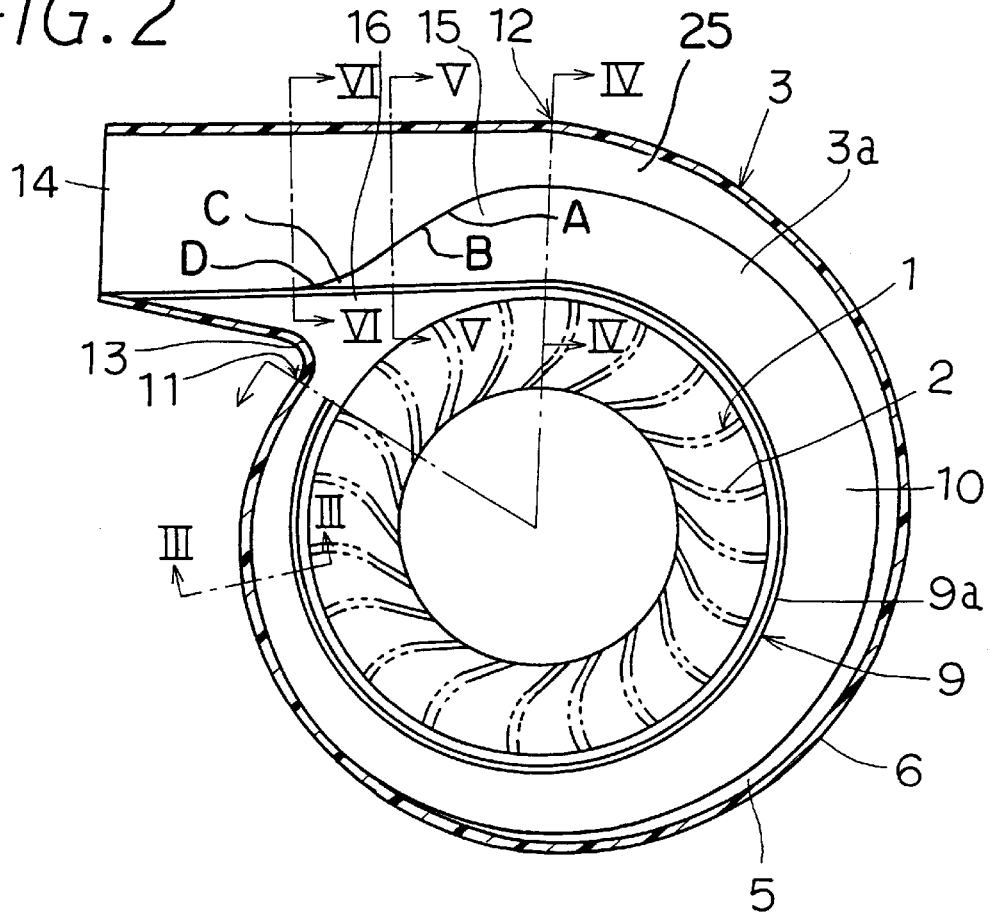
FIG. 2 is a cross-sectional view of the centrifugal blower.
Figure 7:
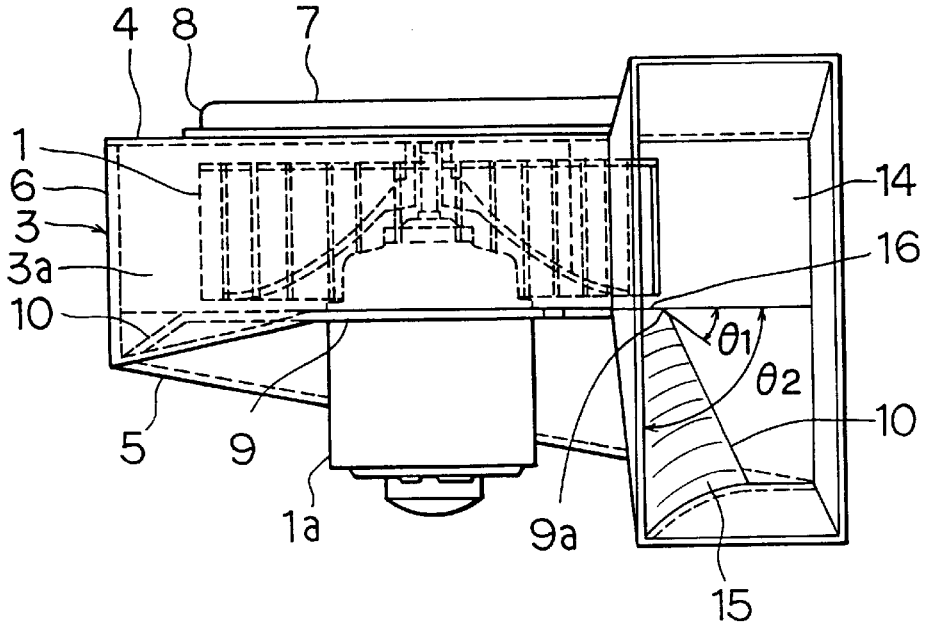
FIG. 7 is a drawing viewed from the direction of an arrow VII in FIG. 1, showing the centrifugal blower.

The air passage 3*a*is formed around the fan 1 in a spiral shape as shown in FIGS. 1 and 2. The width of the air passage 3*a* in the radial direction of the fan 1 becomes larger gradually along the direction of air flow. Further, as shown in FIG. 7, the height of the air passage 3*a* becomes larger along the direction of air flow. In other words, it is gradually enlarged from the scroll starting position 11 toward the scroll ending position 12. Accordingly, the cross-sectional area of the air passage 3*a* becomes larger as it approaches the air outlet 14.

On the other hand, as shown in FIGS. 1 and 2, the air passage 3*a* has a window 13 where the scroll starting position 11 connects to a position between the scroll ending position 12 and the air outlet 14.

The ring-shaped face 9 extends in a tangential direction thereof from the scroll ending position 12, to the air outlet 14 thereby functioning as a guide wall 16 for guiding air to the air outlet 14 around the window 13.

That is, in this embodiment, between the scroll starting position 11 and the scroll ending position 12, the ring-shaped face 9 is formed along the outer periphery of the fan 1 and connected to the sloped face 10 through the outside edge face 9*a*. Between the scroll ending position 12 and the air outlet 14, the ring-shaped face 9 extends longitudinally in the tangential direction and is connected to the warped face 15 through the outside edge face 9*a*. The connection between the sloped face 10 and a base face 25 of the lower scroll casing 5 is formed in a spiral shape which gradually increases in its radial direction from the scroll starting position 11 toward the scroll ending position 12. Between the scroll ending position and the air outlet 14, the connection includes a first portion A which is angled radially inward, an inflection point B and a second portion C which blends generally tangential to the sloped face 10 at point D.

Next, features and effects in the embodiment will be described.

In the air passage 3*a*, a flow speed of air flowing in the portion enlarged toward the opposite side of the air inlet 7 (the secondary air flow) is smaller than a flow speed of air flowing close to the fan 1 (the main air flow). Therefore, the secondary air flow would tend to mix with the main air flow around the window 13, whereby turbulence of the air flows would occur.

However,in the embodiment, since the warped face 15 is formed between the scroll ending position 12 and the air outlet 14, the secondary air flow flows along the warped face 15 so as to expand toward the inner side of the fan 1. Therefore, the secondary air flow is prevented from mixing with the main air flow, whereby the interference between the secondary air flow and the main air flow, and that of the secondary air flow and the blades 2 of the fan 1 can be prevented. As a result, noise generated by the interference is lowered.

Further, since the guide wall 16 is formed in the neighborhood of the window 13 for guiding the main air flow to the air outlet 14, the main air flow is prevented from being deflected toward the secondary air flow. As a result, the interference between the main air flow and the secondary air flow is prevented, whereby noise generated by the interferences is further lowered.

Further, since the sloped face 10 is connected to the ring-shaped face 9 through the outside edge face 9*a*, the air blown out from the fan 1 to the opposite side of the air inlet 7 flows smoothly. Therefore, turbulence of the air is prevented, and noise is further lowered.

Figure 8:
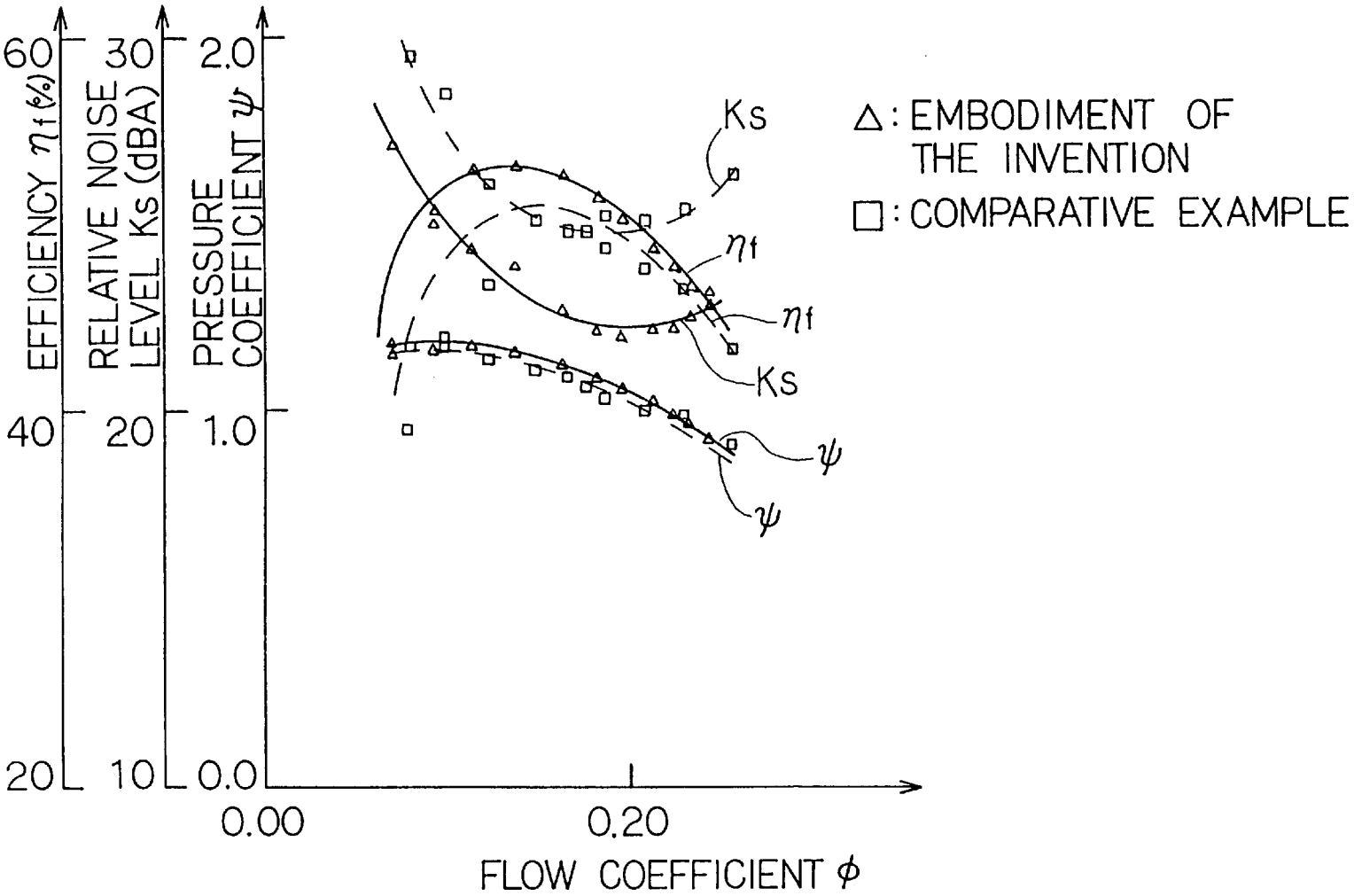
FIG. 8 is a graph showing characteristics of blower efficiency $\eta_f$, relative noise level $K_s$, a and pressure coefficient $\psi$ versus flow coefficient $\phi$ in the centrifugal blower.

FIG. 8 shows characteristics of a blower efficiency $\eta_f$, a relative noise level $K_s$, and a pressure coefficient $\psi$ versus a flow coefficient $\phi$, as to the blower in the embodiment and a blower as a comparative example. The pressure coefficient $\psi$, is a value related to a pressure difference between air drawn from the air inlet and air blown out from the air outlet. The flow coefficient $\phi$ is a value related to an amount of the air blown out from the air outlet.

The blower of the comparative example does not have the warped face 15, and has an sloped triangular face between the window 13 and the air outlet 14 instead of the warped face 15 of the present embodiment. The other features of the comparative example are the same as those of the embodiment.

Compared with the blower of the comparative example, it is apparent that the blower in the embodiment is improved concerning the blower efficiency $\eta_f$, the relative noise level $K_s$, and the pressure coefficient $\psi$. That is, the blower in the embodiment can realize improvement of the blower efficiency, decrease of the noise, and decrease of the pressure loss of air in the air passage 3*a*.

While the present invention has been shown and described with reference to the foregoing preferred embodiment, it will be apparent to those skilled in the art that changes in form and detail may be made therein without departing from the scope of the invention as defined in the appended claims.

Figure 9:
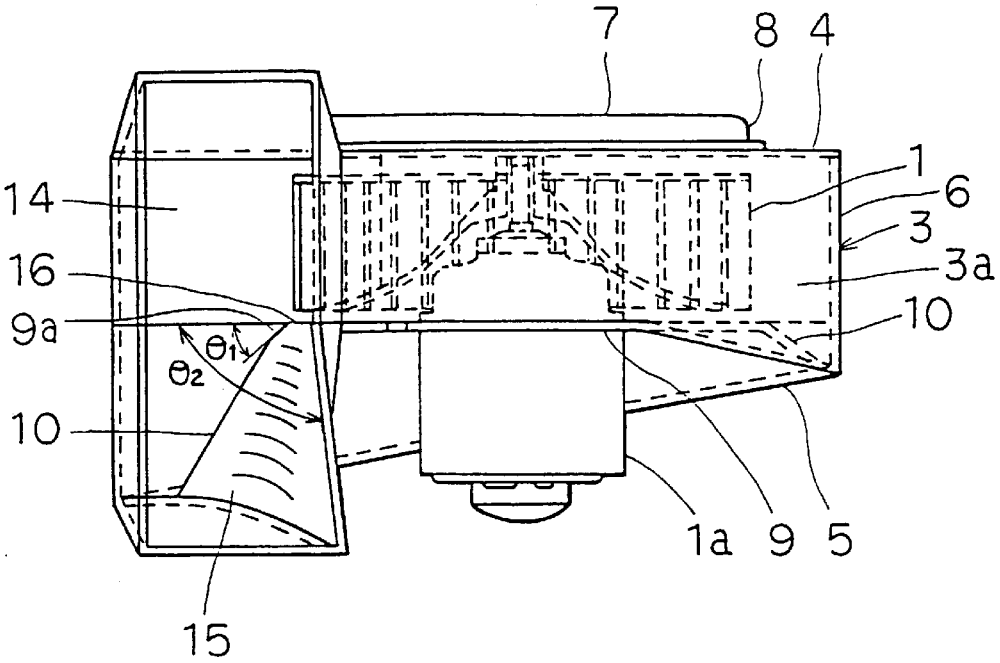
FIG. 9 is a drawing showing a centrifugal blower of a modified embodiment according to the present invention.
Figure 10:
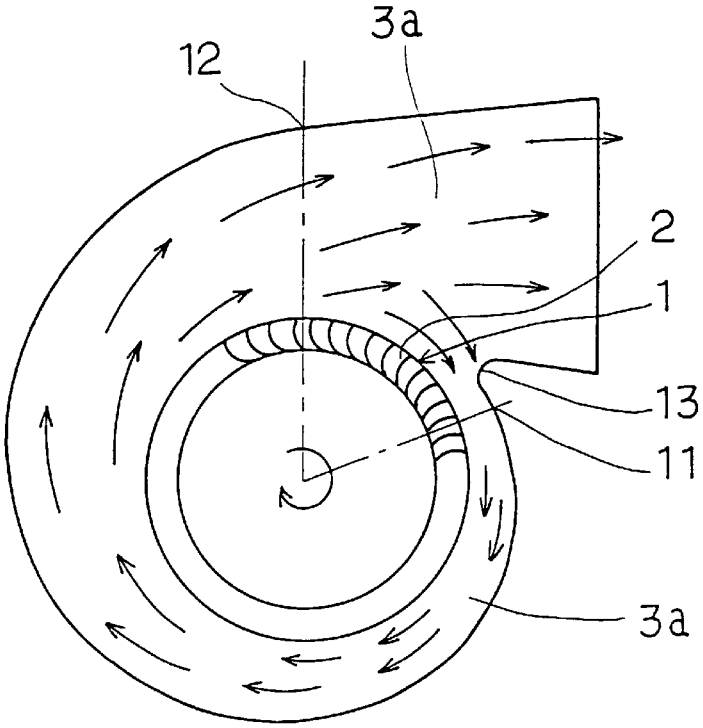
FIG. 10 PRIOR ART
FIG. 10 is a cross-sectional view showing a conventional centrifugal blower and an air flow therein.

For example, although, in the embodiment, the sloped angle $\theta_2$ of the warped face 15 is increased to 90° as shown in FIG. 7, it may be increased over 90° as shown in FIG. 9.

Further, although the sloped angle $\theta_2$ of the sloped face 10 is constant between the scroll starting position 11 and the scroll ending position 12, it may be changed.

The warped face 15 needs not be formed from the scroll ending position 12, and may be formed from the position somewhat different from the scroll ending position 12.

Although the guide wall 16 is formed from the scroll ending position 12 of the scroll 3, the position from which the guide wall 16 starts is not limited to the scroll ending position 12 and it may be shifted.

Variations such as those described above are to be understood as being within the scope of the present invention as defined by the appended claims.

What is claimed is:

1. A centrifugal blower comprising:

a motor;

a centrifugal fan driven by the motor for drawing air into its rotational axial direction and blowing air out to its radial direction; and a scroll casing for holding the centrifugal fan therein and defining an air passage around the centrifugal fan, the scroll casing having a scroll shape with a scroll starting position at a most upstream portion of the air passage and a scroll ending position at a downstream portion thereof from which the air passage further stretches in its tangential direction, the scroll casing including an air outlet disposed at the most downstream portion of the air passage, a lower scroll casing portion disposed at a motor side of the scroll casing, an upper scroll casing portion disposed at a side of the scroll casing opposite the motor and having an air inlet, and a side scroll casing portion connecting the upper and the lower scroll casing portions; wherein the lower scroll casing portion includes a partially circular ring-shaped face disposed to face the centrifugal fan at the motor side, a sloped face connected to the ring-shaped face and sloped outwardly in the radial direction, and a base face connecting the sloped face and the side scroll casing, said ring-shaped face extending tangentially from the scroll ending position longitudinally to the air outlet;

a cross sectional area of the air passage becomes larger from the scroll starting position to the air outlet;

the sloped face warps from the scroll ending position to the air outlet to form a curve surface so that an angle defined by the intersection of the sloped face and the ring-shaped face gradually increases from less than 90° at the scroll ending position to approximately 90° at a point between the scroll ending position and the air outlet; and a curved line defined by the connection between the base face and the sloped face includes a first portion angled radially inward from the scroll ending position and a second portion blending generally tangentially to the sloped face, said first portion and said second portion defining an inflection point at their intersection.

2. A centrifugal blower according to claim 1, wherein the angle made by the sloped face and the ring-shaped face from the scroll starting position to the portion proximate to the scroll ending position is in a range of 15° to 75°.

3. A centrifugal blower according to claim 1, wherein:

the air passage has a window where the scroll starting position connects to a portion between the scroll ending position and the air outlet, and the ring-shaped face extends in a tangential direction thereof from the scroll ending position, and functions as a guide wall for guiding air to the air outlet a round the window.

4. A centrifugal blower according to claim 1, wherein:

the ring-shaped face is connected to the sloped face through an edge face; and a cross-sectional shape of the ring-shaped face, the edge face and the sloped face, which are connected to each other, has a plurality of bending points.

* * * * *

UNITED STATES PATENT AND TRADEMARK OFFICE

CERTIFICATE OF CORRECTION

PATENT NO. : 5,839,879

DATED : November 24, 1998

INVENTOR(S) : Teruhiko Kameoka et al

It is certified that error appears in the above-identified patent and that said Letters Patent is hereby corrected as shown below:

Title Page, [30] Foreign Priority Data, "Dec. 5, 1996" should be --Dec. 5, 1995--

Col. 2, line 66, delete "a"

Col. 3, line 26, delete "as"

Col. 4, line 1, "3ais" should be --3a is--

Col. 4, line 44, "However,in" should be --However, in--

Col. 5, line 8, delete "an" & substitute --a-- therefor

Col. 5, line 33, delete "needs" & substitute --need-- therefor

Col. 6, line 21, claim 1, delete "curve" & substitute --curved-- therefor

Col. 6, line 45, claim 3, "a round" should be --around--

Signed and Sealed this

Fourth Day of May, 1999

*Attest:*

Q. TODD DICKINSON

*Attesting Officer*

*Acting Commissioner of Patents and Trademarks*